US011326485B2

(12) United States Patent
Hess et al.

(10) Patent No.: US 11,326,485 B2
(45) Date of Patent: May 10, 2022

(54) METHOD OF MANUFACTURE AND DESIGN OF CAST-IN-PLACE VALVE SEATS

(71) Applicant: GM Global Technology Operations LLC, Detroit, MI (US)

(72) Inventors: Devin R. Hess, Clarkston, MI (US); Qigui Wang, Rochester Hills, MI (US); Thomas W. Gustafson, Clarkston, MI (US); Dale A. Gerard, Bloomfield Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 30 days.

(21) Appl. No.: 17/014,526

(22) Filed: Sep. 8, 2020

(65) Prior Publication Data

US 2022/0074325 A1 Mar. 10, 2022

(51) Int. Cl.

| | |
|---|---|
| ***F01L 3/22*** | (2006.01) |
| ***C23C 2/12*** | (2006.01) |
| ***B22D 19/00*** | (2006.01) |
| ***F02F 1/24*** | (2006.01) |

(52) U.S. Cl.

CPC ..... *F01L 3/22* (2013.01); *B22D 19/0009* (2013.01); *C23C 2/12* (2013.01); *F02F 1/24* (2013.01)

(58) Field of Classification Search

CPC ... F01L 3/22; F01L 3/02; B22D 19/00; B22D 19/0009

See application file for complete search history.

(56) References Cited

U.S. PATENT DOCUMENTS

| | | | | |
|---|---|---|---|---|
| 3,428,035 | A * | 2/1969 | Horton | F01L 3/02 123/188.8 |
| 5,020,490 | A * | 6/1991 | Seko | F01L 3/22 123/188.8 |
| 5,040,501 | A * | 8/1991 | Lemelson | F01L 3/04 428/408 |
| 5,333,668 | A * | 8/1994 | Jorstad | B22D 19/08 164/102 |
| 2019/0316700 | A1* | 10/2019 | Pickett | F16K 1/42 |

FOREIGN PATENT DOCUMENTS

| | | | | |
|---|---|---|---|---|
| JP | 63056347 | A * | 3/1988 | F02F 1/24 |

* cited by examiner

*Primary Examiner* — Grant Moubry

(74) *Attorney, Agent, or Firm* — Vivacqua Crane PLLC

(57) ABSTRACT

A cylinder head having a cast-in-place valve seat for an automobile vehicle includes a valve seat having an inner wall. At least one retaining feature integrally and homogeneously extends from the inner wall. The valve seat when positioned into a casting mold has the at least one retaining feature assisting in retaining the valve seat in the casting mold. A metal in a molten form is received in the casting mold. A cast component formed after cooling of the metal has the valve seat cast-in-place.

17 Claims, 1 Drawing Sheet

METHOD OF MANUFACTURE AND DESIGN OF CAST-IN-PLACE VALVE SEATS

INTRODUCTION

The present disclosure relates to valve seats for cylinder heads of automobile vehicle engines.

Automobile vehicle engines utilize valve seats of a wear resistant material for cast aluminum cylinder heads. The valve seats are formed separately of the cylinder head which is formed in a casting operation. The valve seats are commonly press-fit into the cylinder head and held in place through an interference fit between the cylinder head and the valve seat.

In addition to initial installation issues of the valve seats, the press-fit valve seats, made of materials having different heat transfer properties than the cylinder heads, may create issues such as leakage and excessive wear from inconsistent heat transfer between the valves, valve seats, and the cylinder head. Additionally, a gap may form between the press-fit valve seat and the aluminum head at high temperature because of different coefficients of thermal expansion (CTE) when the engine is firing.

Thus, while current automobile vehicle cylinder head valve seat designs achieve their intended purpose, there is a need for a new and improved system and method for manufacturing and installing valve seats in cylinder heads.

SUMMARY

According to several aspects, a cast-in-place valve seat for an automobile vehicle includes a valve seat having an inner wall. At least one retaining feature integrally extends from the inner wall. The valve seat when positioned into a core box has the at least one retaining feature assisting in retaining the valve seat in the core sand of the core box prior to a casting operation.

In another aspect of the present disclosure, the at least one retaining feature is formed of the same material as the valve seat.

In another aspect of the present disclosure, a material of the valve seat is formed of a first material and at least one retaining feature is formed of a second material different from the first material.

In another aspect of the present disclosure, at least one retaining feature includes at least one reduced section contact member positioned in direct contact with the inner wall. The reduced section contact member may be of any shape that aids in the removal of the contact member from the valve seat without causing damage to the valve seat.

In another aspect of the present disclosure, at least one retaining feature defines multiple retaining features, having individual ones of the retaining features equidistantly positioned from successive ones of the retaining features about the inner wall of the valve seat.

In another aspect of the present disclosure, at least one retaining feature defines four retaining features provided in four locations including a first location, a second location positioned ninety degrees from the first location, a third location positioned ninety degrees from the second location, and a fourth location positioned ninety degrees from the third location.

In another aspect of the present disclosure, at least one retaining feature is formed using an additive manufacturing process having multiple layers.

In another aspect of the present disclosure, a cladding material is added onto an outside diameter or a bottom of the valve seat.

In another aspect of the present disclosure, at least one retaining feature defines a retaining element fixed at multiple locations to the inner wall of the valve seat, the retaining element including a first retaining element portion having opposed first and second contact members.

In another aspect of the present disclosure, the first contact member and the second contact member define oppositely facing elements that individually contact opposed positions of the inner wall.

According to several aspects, a cylinder head having a cast-in-place valve seat for an automobile vehicle includes a valve seat having an inner wall. At least one retaining feature extends from the inner wall. The valve seat when positioned into a core box has the at least one retaining feature assisting in retaining the valve seat in a sand core. The valve seat and the sand core are positioned within a casting mold. A metal in a molten form is received in the casting mold. A cast component formed after cooling of the metal has the valve seat cast-in-place.

In another aspect of the present disclosure, the valve seat is positioned within the core box. The valve seat may be positioned by but not limited to a robot, a pneumatic tube, or a person.

In another aspect of the present disclosure, the port core includes an outer wall, with at least one retaining feature of the valve seat directly contacting and engaging the outer wall of the port core.

In another aspect of the present disclosure, multiple reduced section contact members such as but not limited to arrow-shaped or wedge-shaped members extend from the at least one retaining feature and in contact with the inner wall of the valve seat.

In another aspect of the present disclosure, a punching operation mechanically separates the arrow-shaped features from the inner wall of the valve seat.

In another aspect of the present disclosure, at least one retaining feature defines a retaining element fixed at multiple locations to the inner wall of the valve seat.

In another aspect of the present disclosure, the retaining element includes a first retaining element portion having opposed first and second contact members.

According to several aspects, a method of manufacturing a cylinder head having a cast-in-place valve seat for an automobile vehicle incudes: forming a valve seat having an inner wall; extending at least one retaining feature from the inner wall; positioning the valve seat into a core box having the at least one retaining feature assisting in retaining the valve seat in a sand core, positioning the valve seat and the sand core into a casting mold; pouring a metal in a molten form into the casting mold; forming a cast component after cooling of the metal having the valve seat cast-in-place; separating the cast component from the casting mold; and removing the at least one retaining feature.

In another aspect of the present disclosure, the method further includes prior to the positioning step dipping the valve seat in a low melting temperature liquid aluminum alloy to provide an aluminum coating over the valve seat, the aluminum coating defining a cladding layer.

In another aspect of the present disclosure, the method further includes forming a port core within the valve seat having the at least one retaining feature directly contacting and engaging an outer wall of the port core; providing reduced section thickness contact members during the extending step from the at least one retaining feature in contact with the inner wall of the valve seat; and performing the removing step using a punching operation to separate the reduced section thickness contact members from the inner wall of the valve seat.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
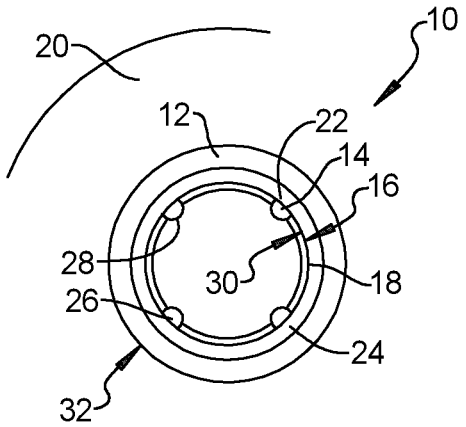
FIG. 1 is a top plan view of a cast-in-place valve seat according to an exemplary aspect.

Referring to FIG. 1, a method of manufacture and design of cast-in-place valve seats 10 includes a valve seat 12 made for example as a print, a powder metallurgy (PM) part from metal powders or casting. The valve seat 12 includes multiple retaining features 14 individually integrally extending from an inner wall 16 of the valve seat 12. According to several aspects the retaining features 14 engage a molding port core 18 positioned within the valve seat 12. The port core 18 and the valve seat 12 are retained in a predetermined position within a casting mold 20 during a casting operation to create a cylinder head for an automobile vehicle engine.

A quantity of the retaining features 14 can vary from one, two, three, four or more. The retaining features 14 are equidistantly positioned from successive ones of the retaining features 14 about the inner wall 16 of the valve seat 12. According to an exemplary aspect four retaining features 14 are provided in four locations including a first location 22, a second location 24 positioned ninety degrees from the first location 22, a third location 26 positioned ninety degrees from the second location 24, and a fourth location positioned ninety degrees from the third location 26, and therefore also approximately ninety degrees from the first location 22.

The retaining features 14 can have any desired geometric shape such as rectangular, mushroom-shaped, dovetail shaped, arrow-head shaped or the like. The retaining features 14 individually and directly contact and engage an outer wall 30 of the port core 18. The valve seat 12 together with the port core 18 are thereby fixed together and retained in position when an outer wall 32 of the valve seat 12 is captured within the casting mold 20.

Referring to FIG. 2 and again to FIG. 1, according to several aspects, prior to positioning the valve seat 12 into the casting mold 20 the port core 18 is made by blowing sand into a core box which contains the valve seat 12 positioned within the core box. The sand hardens around the retaining features 14 discussed in reference to FIG. 1 to engage the valve seat 12 in the port core 18. The port core 18 and the valve seat 12 are together then positioned within the casting mold 20. Molten aluminum is then poured into the casting mold 20 and allowed to cool and solidify with the valve seat 12 cast-in-place. After the now-molded aluminum casting of the cylinder head is removed from the casting mold 20, the port core 18 is removed, for example by machining or by breaking apart the material of the port core 18. The cast-in-place valve seat 12 can then be further machined as necessary.

According to further aspects, the valve seat 12 may be dipped in a low melting temperature liquid aluminum alloy, for example Al-10-13% Si, to provide an aluminum coating over the valve seat 12 prior to placing the valve seat 12 into the core box. The aluminum coating defines a cladding layer that improves metallurgical bonding between valve seat 12 and the aluminum metal poured into the casting mold 20 during casting of the aluminum head.

Figure 2:
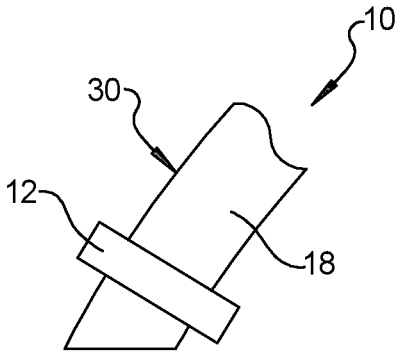
FIG. 2 is a side elevational view of the valve seat of FIG. 1.

Referring to FIG. 3 and again to FIG. 2, an exemplary one of the retaining features 14 is shown extending inwardly from the inner wall 16 of the valve seat 12. According to several aspects, the retaining features 14 may be formed of the same material of the valve seat 12 at the time of forming or printing the valve seat 12, such as by an additive manufacturing process. According to several aspects, the retaining features 14 may be formed of one or more different materials than the material of the valve seat 12. According to further aspects, additional material acting as a cladding material may be added to an outer diameter surface of the valve seat 12 to aid in creating a metallurgical bond between the valve seat 12 and the aluminum cylinder head during the casting process as the aluminum solidifies.

Figure 3:
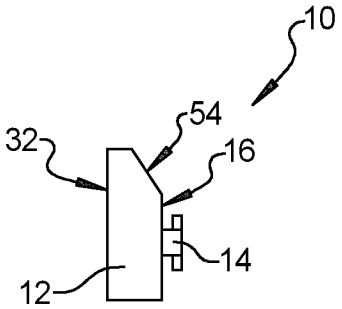
FIG. 3 is a cross sectional view of one of multiple retaining features of the valve seat of FIG. 1.
Figure 4:
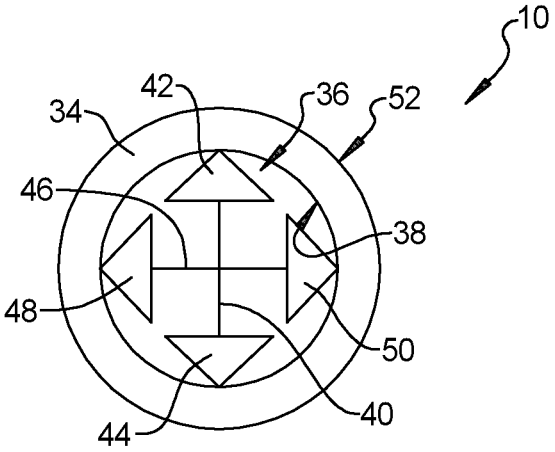
FIG. 4 is a top plan view of a cast-in-place valve seat according to another aspect.

Referring to FIG. 4 and again to FIGS. 1 through 3, a valve seat 34 defines an alternative design with respect to the valve seat 12. The valve seat 34 retaining features defining a retaining element 36 fixed at multiple locations to an inner wall 38 of the valve seat 34. The retaining element 36 may include a first retaining element portion 40 having opposed first and second contact members 42, 44 which according to several aspects may be wedge-shaped or reduced section thickness members. According to several aspects the first contact member 42 and the second contact member 44 may define oppositely facing arrow-head shaped elements that individually contact opposed positions of the inner wall 38. According to further aspects, the retaining element 36 may also include a second retaining element portion 46 having opposed third and fourth contact members 48, 50. According to several aspects the third contact member 48 and the fourth contact member 50 may define oppositely facing wedge-shaped or reduced section thickness members including but not limited to arrow-head shaped elements that individually contact opposed positions of the inner wall 38 at ninety degree rotated positions from the first contact member 42 and the second contact member 44. The valve seat 34 together with the retaining element 36 may also be connected to the port core 18 and then positioned in the casting mold 20 as discussed above with respect to the valve seat 12 with an outer surface 52 of the valve seat 34 in contact with elements of the casting mold 20. Molten aluminum material is then poured into the casting mold 20, with the valve seat 34 cast-in-place.

After the aluminum casting process is completed and the aluminum cast cylinder head is removed from the casting mold 20, the retaining element 36 is removed, for example by a punch process. The punch process removal is available due to the limited contact surfaces provided by the wedge-shaped or reduced section thickness first, second, third and fourth contact members 42, 44, 46, 48 with the inner wall 38.

The remaining cast-in-place valve seat 34 can then be further machined as necessary.

With continued reference again to FIG. 3, it is further noted that the valve seats of the present disclosure such as the valve seat 12 and the valve seat 34 may include one or more surfaces 54 which act for example as contact surfaces for intake or exhaust valve contact surfaces. The retaining features 14 or the retaining element 36 are located to prevent interference with the surfaces 54.

A method of manufacture and design of cast-in-place valve seats of the present disclosure offers several advantages. These include a method where a port core is manufactured to hold a valve seat in position during a casting process. Retaining features formed on an inner diameter of the valve seat contact and retain the valve seat to the port core. Additionally, a metallurgical joining is formed between the valve seat 12 or the valve seat 34 and the aluminum head for better heat transfer to dissipate the heat from the valve seat to aluminum and then to a water jacket coolant. Further, the cast-in-place valve seat also offers design space for improved combustion chamber design for high fuel efficiency.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A cast-in-place valve seat for an automobile vehicle, comprising:

a valve seat having an inner wall; and at least one retaining feature extending from the inner wall; and wherein the valve seat when positioned into a core box has the at least one retaining feature assisting in retaining the valve seat in a sand core prior to a casting operation including filling the casting mold with a molten metal material.

2. The cast-in-place valve seat for the automobile vehicle of claim 1, wherein the at least one retaining feature is formed of a same material as the valve seat.

3. The cast-in-place valve seat for the automobile vehicle of claim 1, wherein a material of the valve seat is formed of a first material and the at least one retaining feature is formed of a second material different from the first material.

4. The cast-in-place valve seat for the automobile vehicle of claim 1, wherein the at least one retaining feature includes at least one reduced section shaped or wedge-shaped contact member positioned in direct contact with the inner wall.

5. The cast-in-place valve seat for the automobile vehicle of claim 1, wherein the at least one retaining feature defines multiple retaining features, having individual ones of the retaining features equidistantly positioned from successive ones of the retaining features about the inner wall of the valve seat.

6. The cast-in-place valve seat for the automobile vehicle of claim 1, wherein the at least one retaining feature defines four retaining features provided in four locations including a first location, a second location positioned ninety degrees from the first location, a third location positioned ninety degrees from the second location, and a fourth location positioned ninety degrees from the third location.

7. The cast-in-place valve seat for the automobile vehicle of claim 1, wherein the at least one retaining feature is formed using an additive manufacturing process.

8. The cast-in-place valve seat for the automobile vehicle of claim 1, further including a cladding material added onto an outer surface of the valve seat to enhance bonding of the valve seat to the metal material.

9. The cast-in-place valve seat for the automobile vehicle of claim 1, wherein the at least one retaining feature defines a retaining element fixed at multiple locations to the inner wall of the valve seat, the retaining element including a first retaining element portion having opposed first and second contact members.

10. The cast-in-place valve seat for the automobile vehicle of claim 9, wherein the first contact member and the second contact member define oppositely facing reduced section shaped elements that individually contact opposed positions of the inner wall.

11. A cylinder head having a cast-in-place valve seat for an automobile vehicle, comprising:

a valve seat having an inner wall;

at least one retaining feature integrally extending from the inner wall;

the valve seat when positioned into a core box having the at least one retaining feature assisting in retaining the valve seat in a sand core, with the sand core and the valve seat then positioned into a casting mold;

a metal in a molten form received in the casting mold; and a cast component formed after cooling of the metal having the valve seat cast-in-place.

12. The cylinder head having the cast-in-place valve seat for an automobile vehicle of claim 11, further including a port core formed within the valve seat.

13. The cylinder head having the cast-in-place valve seat for an automobile vehicle of claim 12, wherein the port core includes an outer wall, the at least one retaining feature of the valve seat directly contacting and engaging the outer wall of the port core.

14. The cylinder head having the cast-in-place valve seat for an automobile vehicle of claim 11, further including multiple reduced section contact members extending from the at least one retaining feature in contact with the inner wall of the valve seat.

15. The cylinder head having the cast-in-place valve seat for an automobile vehicle of claim 14, further including a punching operation acting to mechanically separate the arrow-shaped features from the inner wall of the valve seat.

16. The cylinder head having the cast-in-place valve seat for an automobile vehicle of claim 11, wherein the at least one retaining feature defines a retaining element fixed at multiple locations to the inner wall of the valve seat.

17. The cylinder head having the cast-in-place valve seat for an automobile vehicle of claim 16, wherein the retaining element includes a first retaining element portion having opposed first and second contact members.

* * * * *